US006108813A

United States Patent [19]

Tolliver et al.

[11] Patent Number: 6,108,813

[45] Date of Patent: Aug. 29, 2000

[54] BALLISTIC RESISTANT UPPER ARM ARMOR PIECE

[75] Inventors: Denise M. Tolliver, Marlborough; Diane St. Clair-Kessinger, Westborough; Debra McLean, Hopedale, all of Mass.

[73] Assignee: The United States of America as represented by the Secretary of the Army, Washington, D.C.

[21] Appl. No.: 09/411,523

[22] Filed: Oct. 4, 1999

Related U.S. Application Data

[63] Continuation of application No. 09/093,636, Jun. 4, 1998, abandoned.

[51] Int. Cl.[7] ..... F41H 1/02; F41H 1/04

[52] U.S. Cl. ..... 2/2.5; 2/459; 2/461

[58] Field of Search ..... 2/2.5, 455, 456, 2/459, 461, 462, 463, 465, 16

[56] References Cited

U.S. PATENT DOCUMENTS

| | | | |
|---|---|---|---|
| 4,425,667 | 1/1984 | Harrison . | |
| 4,516,273 | 5/1985 | Gregory et al. | 2/462 |
| 4,783,853 | 11/1988 | Zuber . | |
| 5,060,314 | 10/1991 | Lewis . | |
| 5,204,993 | 4/1993 | Siemens | 2/463 |
| 5,325,537 | 7/1994 | Marion . | |
| 5,353,437 | 10/1994 | Field et al. | 2/462 |
| 5,623,728 | 4/1997 | Wagner | 2/462 |
| 5,987,654 | 11/1999 | Chartrand | 2/462 |

*Primary Examiner*—Michael A. Neas
*Assistant Examiner*—Gary L. Welch
*Attorney, Agent, or Firm*—Vincent J. Ranucci

[57] ABSTRACT

A ballistic resistant upper arm armor piece, for protecting the arm scye, without restricting arm movement, includes a front lobe, a back lobe connected to the front lobe, and means such as an elastic strap with a hook and loop fastener, for securing the lobes to a user's upper arm so that a portion of the front lobe extends around a front portion of the user's torso and a portion of the back lobe extends around a back portion of the torso. The lobes have an upper edge and a lower edge, and together the lobes form a concave portion along the lower edge. The piece also includes means, on the upper edge of the lobes, for interconnecting the lobes to a garment worn by the user. The piece is constructed from a durable outer shell material, which encases an insert composed of multiple layers of ballistic resistant materials.

10 Claims, 3 Drawing Sheets

BALLISTIC RESISTANT UPPER ARM ARMOR PIECE

This application is a continuation of application Ser. No. 09/093,636 filed on Jun. 4, 1998, now abandoned.

GOVERNMENTAL STATEMENT

The invention described herein may be manufactured, used and licensed by or for the Government for Governmental purposes without the payment to us of any royalty thereon.

FIELD OF THE INVENTION

This invention relates to upper arm and arm scye protective gear.

BACKGROUND OF THE INVENTION

Armor pieces for protecting the upper arm of a person are known in the art as disclosed in U.S. Pat. No. 4,425,667 to Harrison and U.S. Pat. No. 5,060,314 to Lewis. However, none of these armor pieces protect the arm scye or major arteries located proximate to the arm scye. Both Harrison and Lewis disclose an upper arm armor piece which wraps partially around the upper arm, but does not overlap the back or front torso area as is necessary to protect the arm scye. These deficiencies in protective gear render the user susceptible to fatal injuries caused by ballistic or other materials which penetrate the arm scye.

Moreover, protective gear, especially ballistic resistant pieces, also tend to be bulky and unduly restrict arm movement. Any attempts thus far to protect the user's arm scye are too bulky and restrict arm movement which also renders the user susceptible to injury

SUMMARY OF THE INVENTION

It is therefore a primary object of this invention to provide a ballistic resistant upper arm armor piece which provides protection to the arm scye through a full range of arm movement necessary for combat operations.

It is a further object of this invention to provide an upper arm armor piece which protects the arm scye yet still allows free lower arm motion including full arm flexion and extension.

It is a further object of this invention to provide an upper arm armor piece which protects the user's brachial artery even when the user's arms are extended backwards.

It is a further object of this invention to provide an upper arm armor piece which protects the user's arm scye and can be adjusted to fit a range of body types and shapes.

It is a further object of this invention to provide a cost effective upper arm armor piece which protects the arm scye through a range of arm movements.

It is a further object of this invention to provide an upper arm armor piece which is lightweight, provides maximum ballistic coverage for major arteries in the arm scye, unilateral and bilateral arm movements and is easy to don and doff.

It is a further object of this invention to provide an upper arm armor piece which protects the arm scye without undue bulk.

It is a further object of this invention to provide an upper arm armor piece which protects the arm scye, without the use of hard materials, to allow better human maneuverability.

It is a further object of this invention to provide an upper arm armor piece which protects the arm scye using soft, pliable body armor materials capable of conforming to the natural roundness of a person's shoulder so that the armor piece is close-fitting and snag-free.

A preferred embodiment of the ballistic resistant upper arm armor piece of this invention for protecting the user's arm scye through a range of arm movements comprises: a front lobe; a back lobe connected with the front lobe; and a means for securing the front and back lobes to the upper arm so that a portion the front lobe extends around a front portion of the torso and a portion of the back lobe extends around a back portion of the torso. The means for securing preferably comprises an elastic strap with a hook and loop fastener. The lobes may further include a means for interconnecting the armor piece to a garment worn by the user. The lobes have an upper edge and a lower edge, and the front and back lobes together preferably form a concave portion along the lower edge. The back lobe is preferably connected to the front lobe to form a unitary, flexible armor piece.

Another preferred embodiment of the ballistic resistant device for protecting a user's upper arm and torso proximate the upper arm, comprises: a kidney-shaped shell; one or more ballistic resistant components encased in the shell; and a means for securing the shell to the upper arm of the user. Based on the user's bustpoint to scapula dimension and an upper arm length, this preferred embodiment preferable comprises kidney-shaped shell having a height and a width, wherein a ratio of the height to width is at least about 0.69 to 1 which corresponds approximately to the ratio of the user's bustpoint to scapula dimension to the user's upper arm length. To accommodate at least a small person, the height should be at least about 12.25 inches and the width should be at least about 16.75 inches.

The shell has an inner side, wherein the means for securing comprises an elastic strap affixed to the inner side of the shell. The shell further comprises a lower third section, and wherein the elastic strap comprises a mid-section which is approximately centered in, and affixed to, the lower third section of the ballistic resistant device, preferably about half an inch from the lower edge of the shell. The elastic strap preferably includes a hook and loop fastener.

The shell preferably has a horizontal curvature which corresponds approximately to the ball of the user's shoulder. The means for securing, when secured to the user's upper arm, further increases this horizontal curvature of the ballistic resistant device. The arm piece has an upper edge, which may comprise a plurality of darts extending down from said upper edge to create the horizontal curvature.

The shell which has an upper edge, may include a means for connecting the device to an epaulet or garment worn by the user proximate the user's shoulder. The shell has a lower edge of which at least a portion may be concave to enable free movement of the user's forearm.

The kidney-shape shell is preferably asymmetrical comprising a front lobe and a back lobe, wherein the front lobe is smaller than the back lobe.

This invention is the result of efforts to design a ballistic resistant upper arm armor piece which protects the arm scye, including the brachial artery, without restricting arm movement. These efforts were part of an overall effort to design a body armor set which increases ballistic protection from low velocity blast antipersonnel mines to mid/high velocity bounding fragmentation antipersonnel mines, distributes protection zones and improves human factor performance.

The armor piece of the invention may be adapted to a person of any size or shape.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE PREFERRED EMBODIMENT

The upper arm armor piece of the invention generally comprises a kidney-shaped shell, one or more ballistic resistant components encased in the shell, and a means for securing the device to the upper arm of the user.

The upper arm armor piece of the invention is intended to cover the area of the user which extends from the shoulder or deltoid muscle, through the acromion area between the shoulder and the elbow, down to the elbow with the breadth extending from the bust point, and curving over the arm to the back shoulder blade. The principal contour of the armor piece is created by three darts which form an arched edge on the ball of the user's shoulder. The armor piece has an asymmetrical shape, designed to cover the arm scye, which has a curved back lobe that is higher than the front lobe.

The contoured, asymmetrical armor piece is constructed from a durable outer shell material which encases an insert composed of multiple layers of ballistic resistant materials. The armor piece is secured to the user's upper arm by means of an elastic strap which is stretched around the user's arm and secured into place with hook and loop fasteners provided on opposing ends of the strap. The mid-section of the strap is stitched into the lower third section of the inner side of the armor piece, while the ends of the strap, on which the hook and loop fasteners are provided, are free to wrap around the biceps of the user. The strap, when fastened around the user's arm, increases the horizontal curvature of the armor piece, thus pressing the arm protection closer to the body. The armor piece also includes a loop sewn into the top and center of the armor piece designed to be looped through an epaulet on the user's garment provided with hook and loop fastener. When the armor piece is secured, the user should be able to move their arm upward, downward, forward and backward. The armor piece remains in place and will not leave an opening at either the front or back arm scye.

Figure 1:
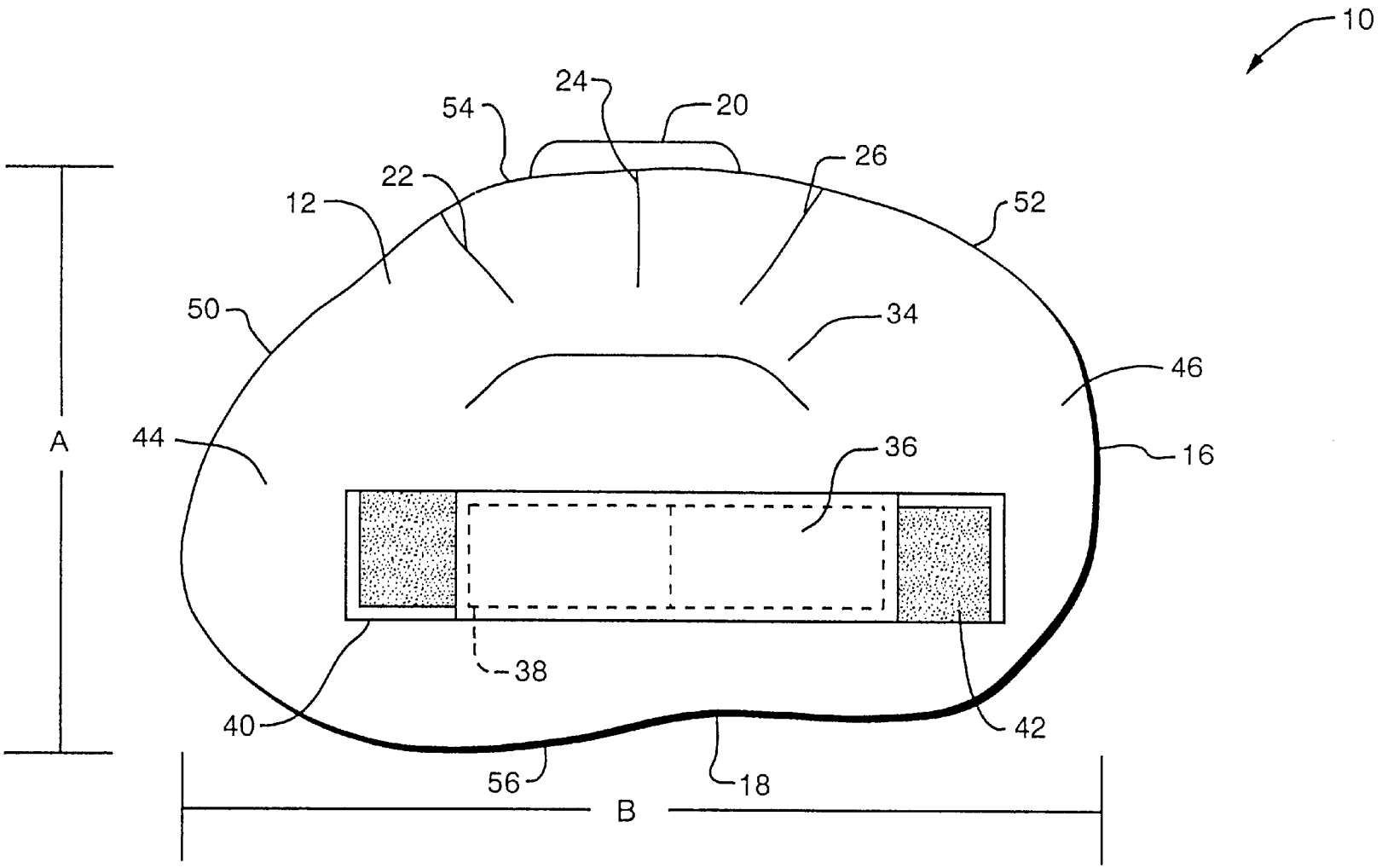
FIG. 1 is a view of the inner side of the preferred embodiment of the invention for use on a left arm.
Figure 2:
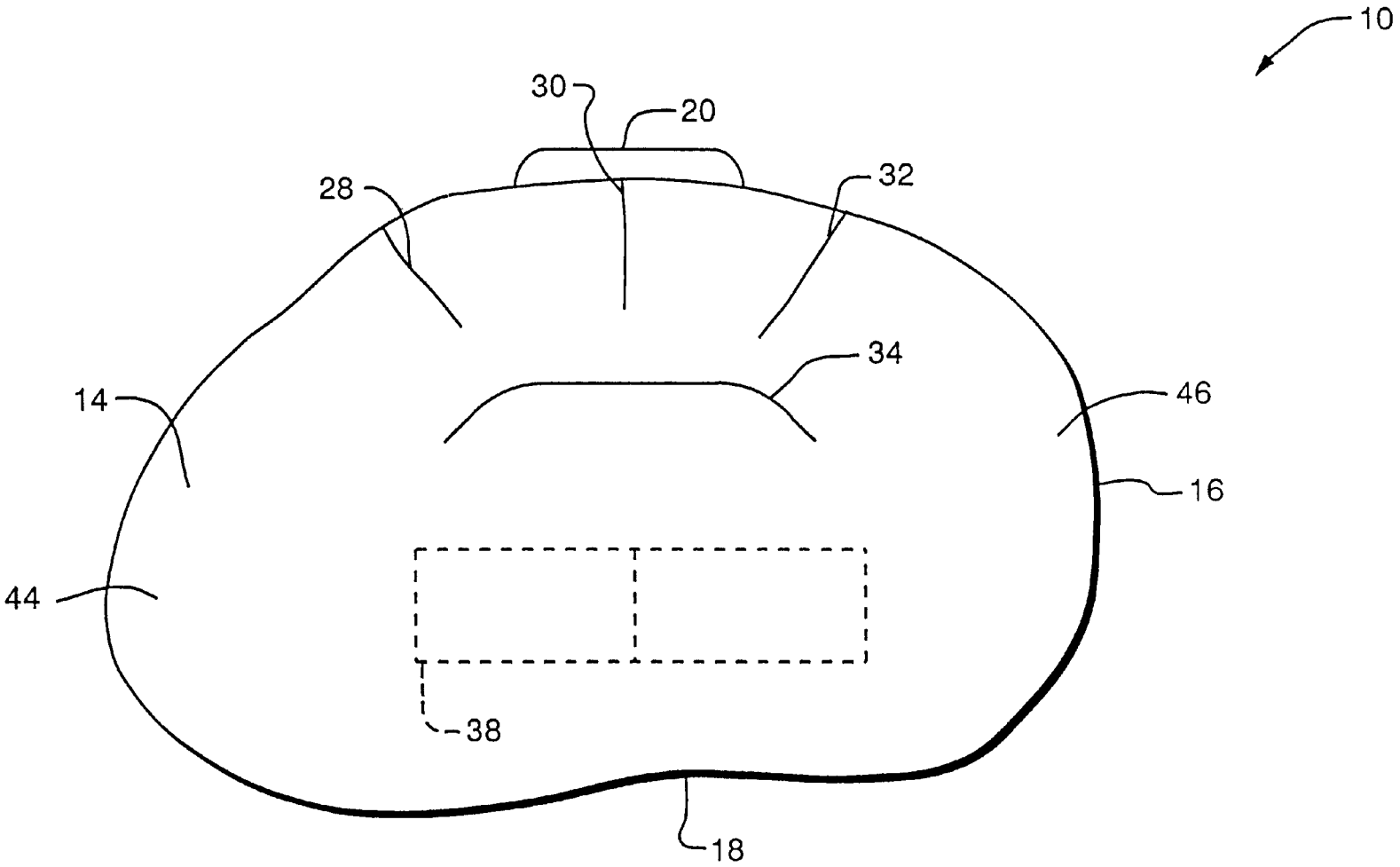
FIG. 2 is a view of the outer side of the preferred embodiment of the invention shown in FIG. 1.
Figure 3C:
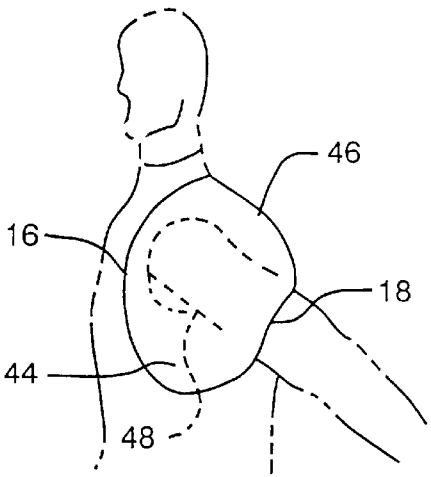
FIGS. 3A, 3B and 3C are views of the preferred embodiment shown in FIG. 1 in use on a human figure.

The inner side of the preferred embodiment of the armor piece, generally referred to as armor piece 10, of the invention is shown in FIG. 1, and the outer side is shown in FIG. 2. Armor piece 10 is designed for use on a user's left arm. An armor piece for use on a user's right arm would be the mirror image of FIGS. 1 and 2. Darts 22, 24 and 26 are sewn into inner piece 12 extending down from the upper edge and darts 28, 30 and 32 are sewn into outer piece 14 extending down from the upper edge. Shell 16 is formed from these two asymmetrical, kidney-shaped pieces, inner piece 12 and outer piece 14 which are sewn together around their perimeters leaving the bottom edge open. Webbing loop 20 is simultaneously sewn into the seam at the top of shell 16. Pieces 12 and 14 are each asymmetrical so that back lobe 46 of each kidney-shaped piece is larger than front lobe 44 of each piece. Front lobe has an upper edge 50 that angles down more sharply from the center of top edge 54 than upper edge 52 of back lobe 46. Concave portion 18 is formed in bottom edge 56 of shell 16. This concave area in the bottom edge allows for free lower arm motion including full arm flexion and extension. The smaller front lobe portion is designed to cover the front torso side to protect the brachial artery when the upper arm is extended backward. Likewise, to conduct any operational tasks that require use of the arms and hands, the arms must be able to swing freely in towards the front of the user. Therefore, the more sharply tapered top edge of the front lobe allows free movement of the arms towards the front of the user while still protecting the arm scye 48 when the arms are extended toward the back of the user as shown in FIG. 3C.

The preferred outer shell material is 1000 denier Cordura® nylon, durable water repellant urethane coated cloth with woodland camouflage pattern. This material conforms to MIL-C-43734, class 3, except for the four color camouflage pattern. Webbing loop 20 is a strip of similarly tough nylon or canvas material having finished longitudinal edges to prevent fraying. Other durable materials may be used which are suitable for the given particular conditions of use.

A multi-layer ballistic insert, (not shown), is encased between inner and outer pieces 12 and 14. The ballistic materials preferably comprise 30 plies of Aramid (KM2® 850 denier). The ballistic cloth is preferably constructed with a multifilament polyamide yarn having a minimum degrading temperature of 850° F. (454° C.). The nominal denier for the warp and filling yarn is preferably 850 denier and the minimum breaking strength for the warp and filling yarn is preferably 30 pounds. Minimum fabric weight is preferably 6.8 ounces per square yard and the weave is preferably plain.

Ten layers of the Aramid are cut from three different ballistic liner pattern pieces. Each of the thirty individual layers are darted with butt seams, (not lapped seam). The three different cuts (ten layers each) are placed into a sleeve in three slightly different locations to avoid overlapping all darts one on top of another. Staggered layers result in a low bulk perimeter, minimizing ballistic vulnerability by offsetting the location of the darts versus placing darts in the same location for each layer. The ballistic layers are slid into prepared outer shell 16 and a closing seam is stitched on the bottom edge of shell 16.

Stitch 34 is preferably sewn through all layers of shell 16, including the encased ballistic materials. Stitch 34 is generally shaped to follow the curve of the user's shoulder.

Strap 36 is preferably made from an elastic material. The length of elastic strap 36 will depend on the circumference of the user's arm and the elasticity of the material used. The mid-section of strap 36 is sewn to the lower portion of armor piece 10, about half an inch from the lower edge of armor piece 10, completely through all the layers of shell 16 and the ballistic inserts as shown by stitch 38. Hook and loop fasteners 40 and 42, such as Velcro®, are sewn into the free ends of strap 36.

Figure 3B:
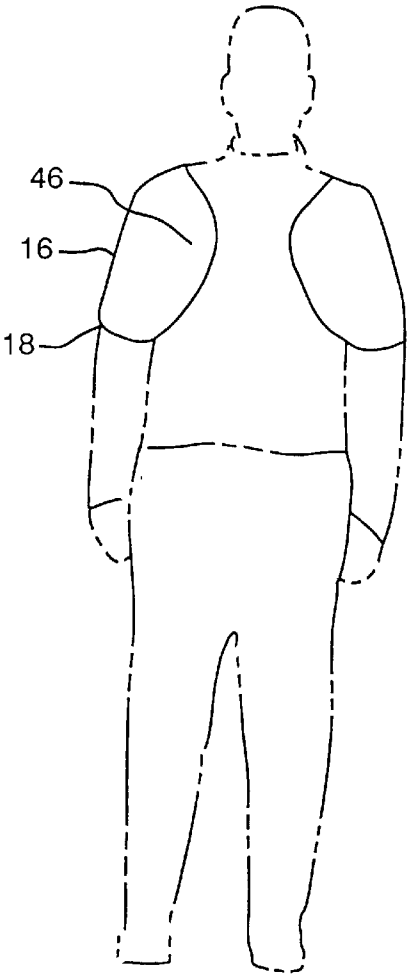
Figure 3A:
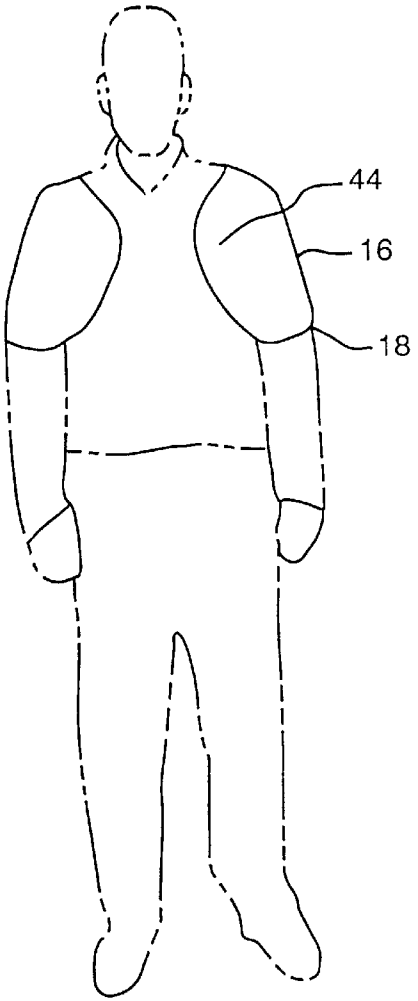

Armor piece 10 is preferably doffed by looping webbing loop 20 through an epaulet, having a hook and loop fastener, provided on the shoulder of the torso garment and adjusted for length so that concave portion 18 does not extend below the elbow. Armor piece 10 is positioned so that front lobe 44 extends forward towards the user's chest. It is important that armor piece 10 does not extend down the arm below the level of the elbow joint to prevent restriction of mobility. Once the proper height of armor piece 10 is fixed, the ends of elastic strap 36 are snugly wrapped around the biceps of the user and pressed together. Once armor piece 10 is properly secured, lobes 44 and 46 should extend partially around and fit closely against the user's front and back torso, respectively, as shown in FIGS. 3A and 3B.

The height A and width B of armor piece 10 are of sufficient dimension to adequately cover the arm scye opening when the user's arms are extended backwards, as shown in FIG. 3C, and yet not restrict arm motion. Based on a range of human sizes covering the general population of men and women, height A and width B, for small, medium and large persons are preferably as follows, in inches:

| | SMALL | MEDIUM | LARGE |
|---|---|---|---|
| HEIGHT | 12.25 | 13.38 | 14.50 |
| WIDTH | 16.75 | 18.75 | 20.75 |

The ratio of height to width ranges from about 0.69 to 1.00 to about 0.73 to 1.00 to accommodate the general population of men and women. These dimensions are designed to create an armor piece having an upper arm height A which will extend from the shoulder area of the deltoid muscle, through the acromium area, between the shoulder and elbow, down to the elbow, and a width B having a breadth extending from the bust point and curving over the arm to the back shoulder blade.

A fit study was conducted on human subjects to verify that the above listed prototype measurements would adequately cover the arm scye without restricting arm movement. The results of this fit study are set forth in the Memorandum Report by Dr. Robert Woods, GEO-Centers, Inc. entitled "Anthropometry Support to the Development of the BASIC P31 Countermine Ensemble", dated Oct. 28, 1997, which is hereby incorporated by reference.

The upper arm armor piece of this invention is not limited to ballistic resistant applications and may be adapted to other conditions where protection for the upper arm and arm scye is desired, including protective gear for explosive ordnance disposal, athletic activities and animal training. Although specific features of the invention may be shown in some drawings and not others, this is for convenience only, as some feature may be combined with any or all of the other features in accordance with the invention.

Other embodiments will occur to those skilled in the art and are within the following claims:

1. A ballistic resistant device for protecting a user's upper arm and torso proximate said upper arm, comprising, a kidney-shaped shell;

one or more ballistic resistant components encased in said shell; and a means for securing said shell to said upper arm of said user; wherein said shell has an inner side, wherein said means for securing comprises an elastic strap affixed to said inner side of said shell; wherein said shell has a horizontal curvature which corresponds approximately to the ball of the user's shoulder; and wherein said shell has an upper edge, further comprising a plurality of darts extending down from said upper edge thereby creating said horizontal curvature.

2. The ballistic resistant device of claim 1 wherein the user has a bustpoint to scapula dimension and an upper arm length, wherein said kidney-shaped shell has a height and a width and wherein a ratio of said height to width is at least about 0.69 to 1 which corresponds approximately to the ratio of the user's bustpoint to scapula dimension to the user's upper arm length.

3. The ballistic resistant device of claim 2, wherein said height is at least about 12.25 inches and said width is at least about 16.75 inches.

4. The ballistic resistant device of claim 1, wherein said shell has a lower edge, and wherein said elastic strap comprises a mid-section which is approximately centered in, and affixed to, said shell about one half inch from said lower edge of said shell.

5. The ballistic resistant device of claim 1, wherein said means for securing, when secured to said user's upper are, increases said horizontal curvature of said shell.

6. The ballistic resistant device of claim 5, wherein said means for securing further comprises a hook and loop fastener.

7. The ballistic resistant device of claim 1, wherein said shell has an upper edge, further comprising a means for connecting said shell to a garment worn by said user proximate said user's shoulder.

8. The ballistic resistant device of claim 1, wherein said kidney-shaped shell is asymmetrical comprising a front lobe and a back lobe, wherein said front lobe is smaller than said back lobe.

9. The ballistic resistant device of claim 1, wherein said shell has a lower edge of which at least a portion is concave.

10. The ballistic resistant device of claim 1, wherein said shell, said ballistic resistant components and said means for securing comprise only pliable materials.

* * * * *